US005760552A

United States Patent [19]

Chen et al.

[11] Patent Number: 5,760,552

[45] Date of Patent: Jun. 2, 1998

[54] METHOD OF CONTROLLING DRIVING POWER OF DOUBLE-SOLENOID ELECTRIC PERCUSSION TOOLS

[75] Inventors: Hsing-Theng Chen, Hsin-Chu; Jou-Sheng Hu, Chung-Li, both of Taiwan

[73] Assignees: Regitar Power Co., Ltd., Taichung; Chung-Shan Inst. of Science Technology, Lung-Tan, both of Taiwan

[21] Appl. No.: 735,585

[22] Filed: Oct. 23, 1996

[51] Int. Cl.[6] ..... H01F 7/18

[52] U.S. Cl. ..... 318/122; 310/14; 335/256

[58] Field of Search ..... 318/114, 119, 318/122, 123, 124, 125, 126; 310/12, 14, 15; 335/232, 235, 255, 256, 266

[56] References Cited

U.S. PATENT DOCUMENTS

| | | |
|---|---|---|
| 3,552,627 | 1/1971 | Moreno . |
| 3,673,475 | 6/1972 | Britton, Jr. . |
| 4,494,098 | 1/1985 | Haneda et al. . |
| 4,550,302 | 10/1985 | Watanabe et al. . |
| 5,079,459 | 1/1992 | Huston et al. . |
| 5,300,908 | 4/1994 | Stone et al. . |

*Primary Examiner*—Bentsu Ro

*Attorney, Agent, or Firm*—Morton J. Rosenberg; David I. Klein; Jun Y. Lee

[57] ABSTRACT

A method of controlling driving power of a double-solenoid electric percussion tool utilizing the change of energizing time of the first solenoid to control the location of a hammer when the first solenoid is switched to the second solenoid so as to increase the driving power of a percussion tool.

3 Claims, 5 Drawing Sheets

METHOD OF CONTROLLING DRIVING POWER OF DOUBLE-SOLENOID ELECTRIC PERCUSSION TOOLS

BACKGROUND OF THE INVENTION

1. Field of the Invention

This invention is related to a method and in particular to one utilizing two solenoids to control the driving power and driving speed of a percussion tool.

2. Description of the Prior Art

It has been found that the conventional electric percussion tool utilizes a single solenoid to act as a magnet when carrying a current so as to attract a hammer to move along a straight line. As shown in FIG. 1, when the switch SW is turned on, a current flows through the solenoid L thereby producing a magnetic field and therefore applying a force F to move the hammer 10 to the right. As the switch SW is turned off, no current flows through the solenoid L and the spring 20 returns the hammer 10 to its original position. However, in order to drive the hammer 10 effectively, the hammer 10 must be longer than the solenoid L so as to maintain a constant direction of the force F applied to the hammer 10 and prevent the production of a reaction force from applying to the hammer when the front end of the hammer is moved to the end of the solenoid.

Nevertheless, the volume and weight of the percussion tool will be increased if a hammer longer than the solenoid is utilized to avoid the decrease of driving power. Further, the resiliency of the spring has to be increased so as to ensure that the hammer can be returned to its original position when the switch is turned off. Unfortunately, the increase in the resiliency of the spring will decrease a portion of the force applied to the hammer thus lowering the driving power. As a result, the single solenoid percussion tool cannot provide satisfactory driving power.

Therefore, it is an object of the present invention to provide a method of controlling driving power and driving speed of percussion tools which can obviate and mitigate the above-noted drawbacks.

SUMMARY OF THE INVENTION

This invention relates to a method of controlling driving power of a percussion tool which utilizes two solenoids instead of a single solenoid to control the hammer. The total length of the two solenoids L1 and L2 is just equal to the length L of a single solenoid of a prior art percussion tool so that the stroke of the hammer remains unchanged (see FIG. 2). Hence, it is only necessary for the hammer to be longer than the respective solenoids L1 and L2 in order to prevent the production of a reaction force from applying to the hammer. In other words, it is unnecessary to increase the length of the hammer (actually, the hammer can be reduced in length) and so the weight of the percussion tool and the resiliency of the spring will not be increased. Further, the force applied to the hammer is directly proportional to $n^2 i^2$ (wherein n represents the number of coils of the solenoid per unit length, i the current flowing through the solenoid). Under the condition that the number of coils of the solenoid remains unchanged (i.e. n is a constant number), the current flowing through the solenoid will be increased if the length of the solenoid is reduced (the voltage is kept constant and the resistance is decreased). Hence, the magnetic force produced by the solenoids L1 and L2 will be much greater than that produced by the single solenoid L. As a consequence, there is no doubt that a percussion tool can be increased in driving power without increasing the resiliency of the spring and the weight of the percussion tool by replacing the single solenoid with two solenoids.

It is the primary object of the present invention to provide a method which can accurately control the driving power of a percussion tool and can obtain the maximum driving power and speed of the hammer.

It is another object of the present invention to provide a method which can increase the driving power of a percussion tool without increasing the length of the hammer and the resiliency of the spring.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
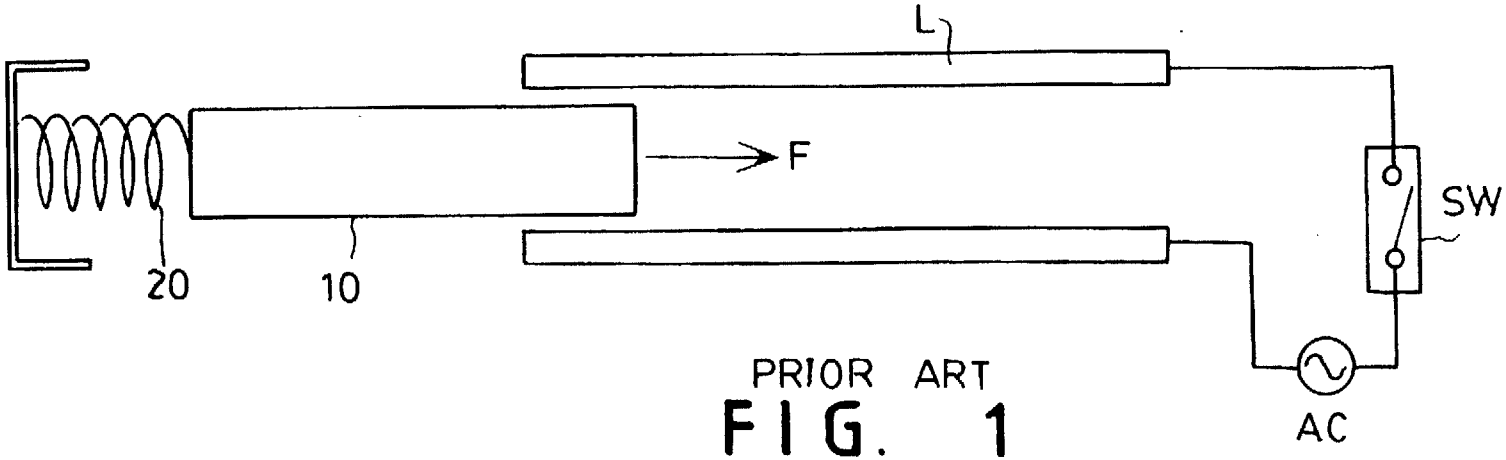
PRIOR ART FIG. 1
FIG 1. is a schematic view illustrating a prior art method of utilizing a single solenoid to drive a hammer of a percussion tool.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
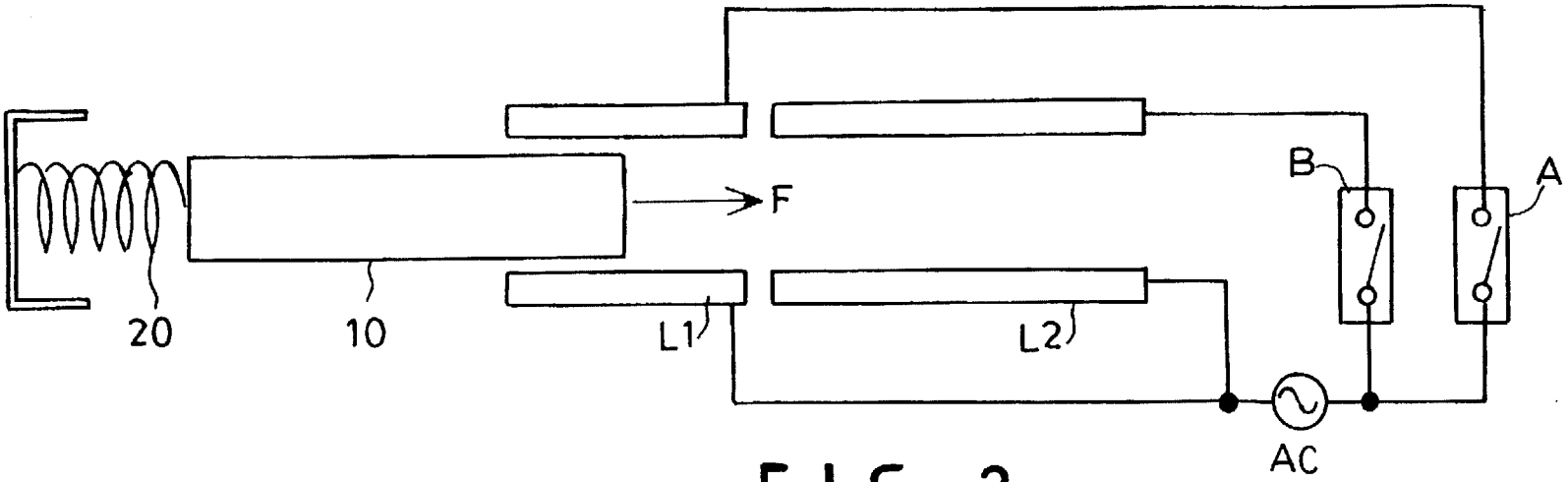
FIG. 2 is a schematic view illustrating a method of utilizing two solenoids to drive a hammer of a percussion tool according to the present invention.
Figure 3A:
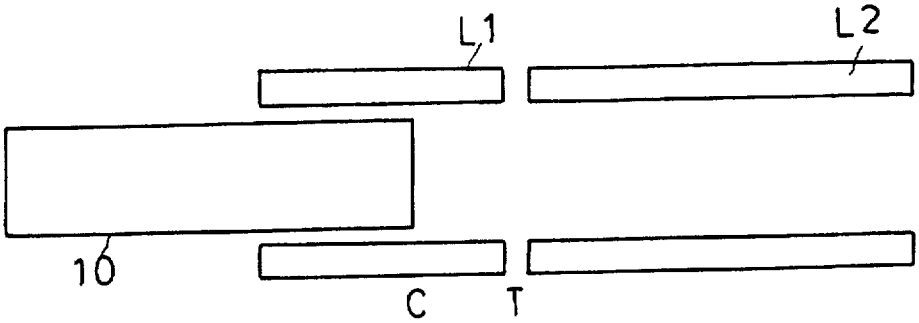
FIG. 3 illustrates the first location of the point C.
FIG. 3B illustrates the second location of the point C.
FIG. 3C illustrates the third location of the point C.
Figure 3B:
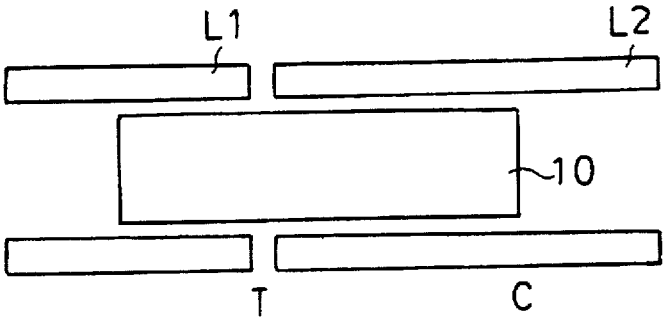
Figure 4A:
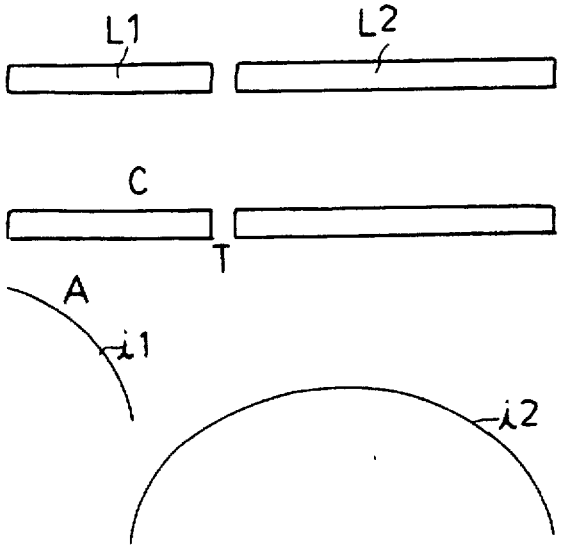
FIGS. 4A, 4B and 4C illustrate different locations of the point C.
Figure 4B:
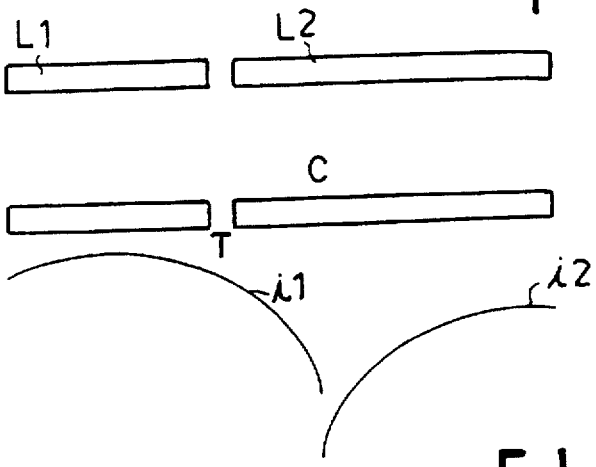

With reference to the drawings and in particular to FIG. 2 thereof, when the switch A is turned on, the first solenoid L1 will exert a force F on a hammer 10. As the hammer 10 moves to a certain point C, the switch A is turned off and the switch B is turned on. In the meantime, the current through first solenoid L1 stops and the magnetic field produced thereby collapses, while the second solenoid L2 will be energized to exert a force F on the hammer 10. Accordingly, the hammer 10 will be subjected to different impulses at different locations. Referring to FIG. 3A, the point T represents the interface between the first solenoid L1 and the second solenoid L2 and the point C is located at the left side of the point T, so that when the left end of the hammer 10 is moved to the position between the points C and T, no current will flow through the first solenoid L1 (i=0) which will not apply force to the hammer 10, whereas current (i) will flow through the second solenoid L2 which will apply force to the hammer 10 (see FIG. 4A). However, as the hammer 10 is still far from the second solenoid L2, the force applied to the hammer 10 by the second solenoid L2 approaches to zero. The larger the distance between the points C and T, the smaller the impulse applied to the hammer 10. As shown in FIG. 3B, the point C is located at the right side of the point T so that when the hammer 10 is moved to the position between the points T and C, the second solenoid L2 is not yet energized and will not apply force to the hammer 10. In the meantime, there is still current flowing through the first solenoid L1, but since the right end of the hammer 10 exceeds the first solenoid L1, the force applied to the hammer 10 by the first solenoid L1 will be greatly decreased and will even tend to move the hammer 10 to go backward thereby decreasing the net impulse applied to the hammer 10 (see FIG. 4B). In short, the larger the distance between the points T and C, the smaller the impulse applied to the hammer 10.

Figure 3C:
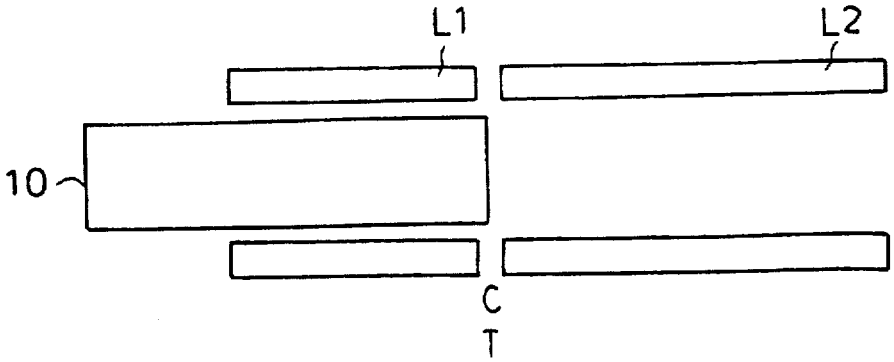
Figure 4C:
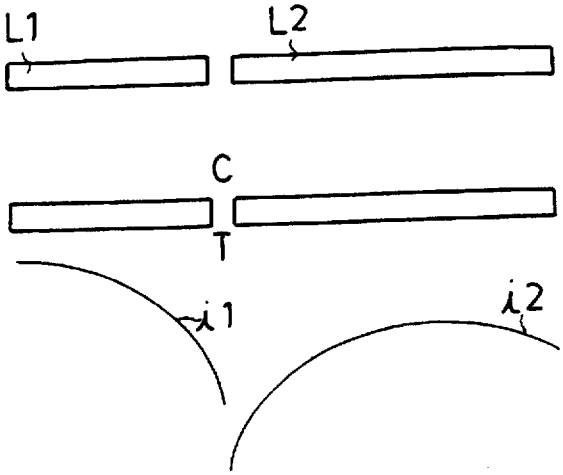
Figure 4D:
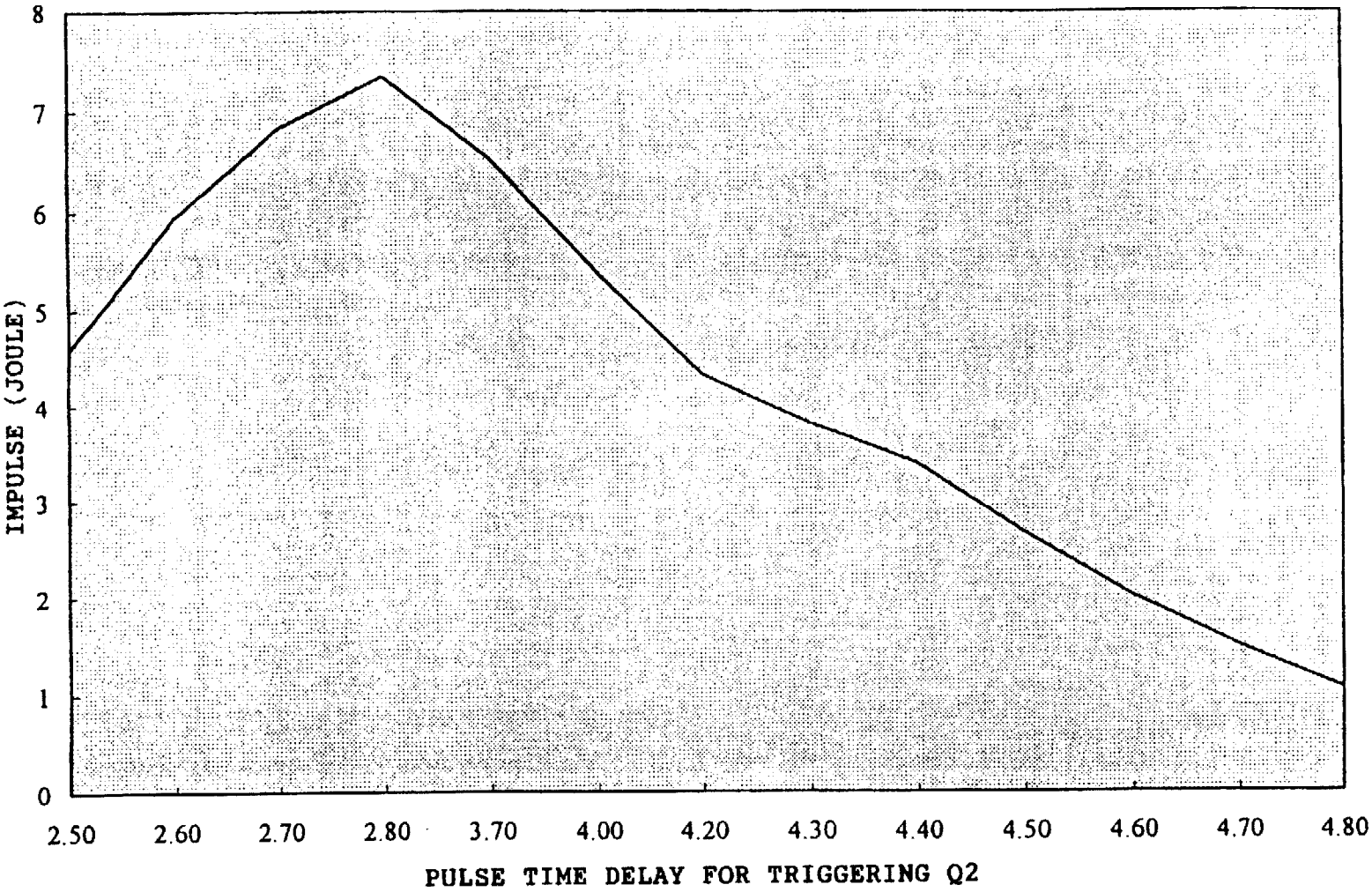
FIG. 4D illustrate different trigger impulse phase of Q2 to driving power of the percussion tool.

As shown in FIG. 3C, the point C is coincident with the point T so that no matter where the front end of the hammer 10 is located, there will be one solenoid (see FIG. 4C) which will be energized and will produce a force to move the hammer 10 to go forward. Thus, the total amount of impulse applied to the hammer 10 will be the greatest. With regard to the utilization of energy, the mode shown in FIG. 3C will be the most efficient. Hence, the designer may adjust the energizing time of the first and second solenoids (i.e. adjusting the location of the point C) to obtain the desired impulse.

Figure 5:
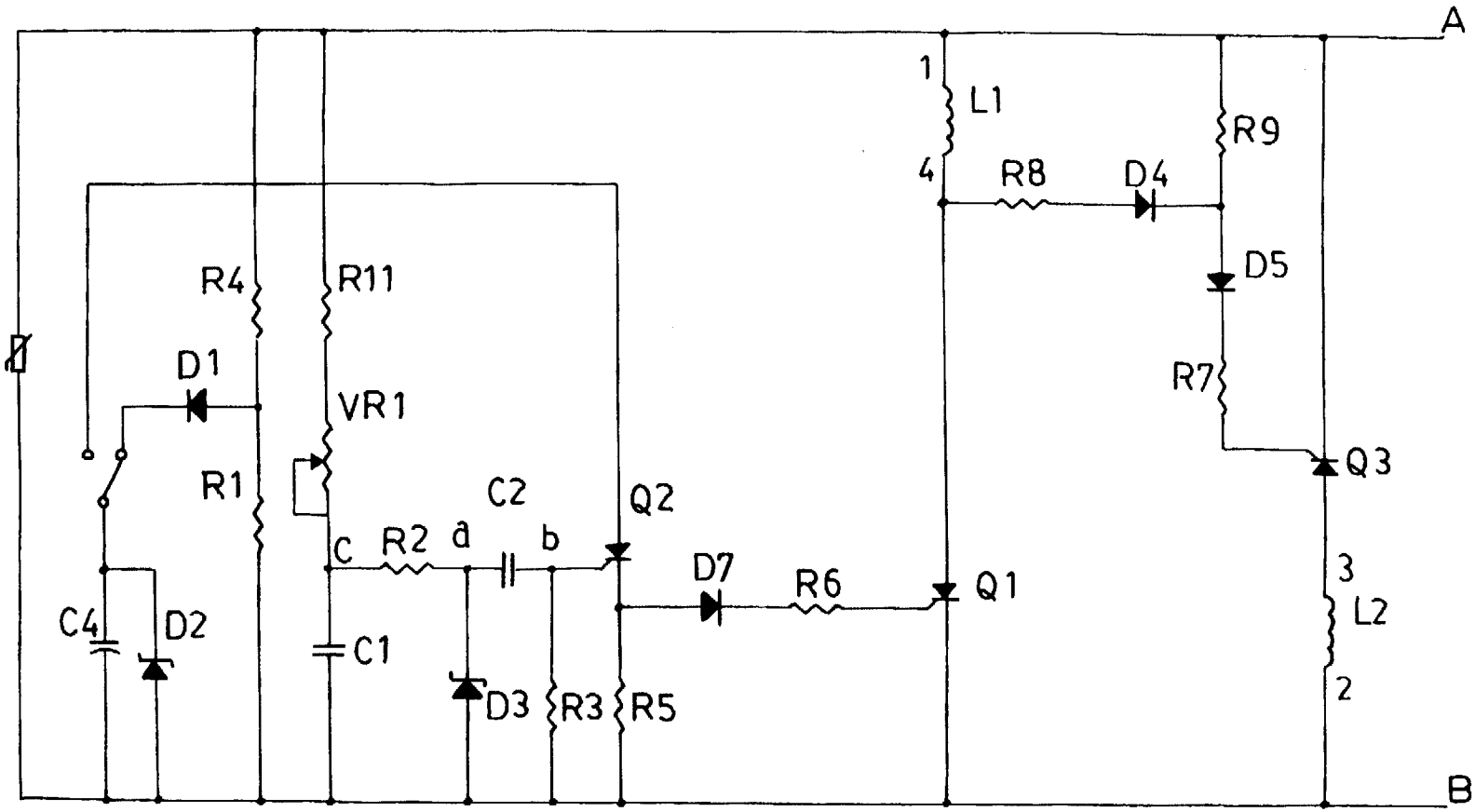
FIG. 5 is a circuit diagram of the driving means according to the present invention.

In brief, the method according to the present invention utilizes the location of the point C to adjust the driving power of the double-solenoid electric percussion tool. According to the method, the percussion tool can obtain its maximum driving power and can be easily adjusted in the driving power as desired. The means according to the present invention for controlling the location of the point C is shown in FIG. 5. The circuit shown in FIG. 5 is utilized to control the time of current flowing through the first solenoid L1 so that when the hammer 10 moves to the point C, the current flowing through the first solenoid L1 will stop while a current will flow through the second solenoid L2. The silicon-controlled rectifier Q1 shown in FIG. 5 is equivalent to the switch A shown in FIG. 2, whereas the silicon-controlled rectifier Q3 equivalent to the switch B. The terminals A and B are connected to an AC power supply so that when the positive cycle is applied to the terminal A, the capacitor C4 will be charged via the resistor R4 and the diode D1 until the voltage applied to the capacitor C4 is equal to the rated voltage of the zener diode D2. As the percussion tool is triggered, the rated voltage will be applied to the anode of the silicon-controlled rectifier Q2. In the meantime, the gate of the silicon-controlled rectifier Q2 will be triggered by a pulse signal causing the capacitor C4 to discharge through the silicon-controlled rectifier Q2. Then, the silicon-controlled rectifier Q1 will be triggered. Hence, a current will flow through the solenoid L1, which will be energized to apply a force to the hammer 10. As all charge stored in the capacitor C4 has been discharged, the silicon-controlled rectifier Q2 will be cut off, preventing the silicon-controlled rectifier Q1 from being triggered by mistake. During the negative cycle, no current will flow through the first solenoid L1, the silicon-controlled rectifier Q3 will be conducted, and the second solenoid L2 will be energized to apply a force to the hammer 10. This circuit is characterized by utilizing a RC phase-shift circuit comprising a resistor 11, a varible resistor VR1 and a capacitor C1 to produce a sinewave signal lagging behind the AC power supply at the point C. The sinewave signal is converted into a one-half cycle of square waves at the point a, which is then filtered by C2 and R3 to form a pulse signal at the point b hence triggering the silicon-controlled rectifier Q2. The phase-shift circuit can be adjusted by regulating the variable resistor VR1 (i.e. obtaining the location C of the hammer shown in FIGS. 3 and 4). Hence, the first and second solenoids L1 and L2 can be accurately energized at predetermined times thereby obtaining the desired power.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

We claim:

1. A method of controlling driving power of an electric percussion tool, characterized by controlling location of a hammer when a first solenoid is switched to a second solenoid so as to increase driving power of a percussion tool.

2. The method of controlling driving power of an electric percussion tool as claimed in claim 1, wherein energizing time of said first solenoid is utilized to control location of said hammer when said first solenoid is switched to said second solenoid.

3. The method of controlling driving power of an electric percussion tool as claimed in claim 1, wherein energizing time of said first solenoid is controlled by a RC phase-shift circuit, said RC phase-shift circuit producing a sinewave signal lagging behind a AC power supply by a time T which can be adjusted by a variable resistor thereby controlling energizing time of said first solenoid.

* * * * *